United States Patent [19]

Locati et al.

[11] Patent Number: 5,064,383

[45] Date of Patent: Nov. 12, 1991

[54] MULTIPLE CONDUCTOR CABLE CONNECTOR WITH CLIP AND TOWERS

[75] Inventors: Ronald P. Locati, Harrisburg; Carl D. Oberman, New Cumberland, both of Pa.

[73] Assignee: AMP Incorporated, Harrisburg, Pa.

[21] Appl. No.: 613,348

[22] Filed: Nov. 14, 1990

[51] Int. Cl.[5] ..... H01R 9/11

[52] U.S. Cl. ..... 439/405; 439/417

[58] Field of Search ..... 439/404, 405, 417, 418

[56] References Cited

U.S. PATENT DOCUMENTS

| | | | |
|---|---|---|---|
| 4,068,912 | 1/1978 | Hudson, Jr. et al. | 339/99 R |
| 4,145,103 | 3/1979 | Knowles | 339/99 R |
| 4,188,083 | 2/1980 | Knowles | 339/99 R |
| 4,296,989 | 10/1981 | Larson et al. | 339/99 R |
| 4,410,229 | 10/1983 | Stephenson | 339/98 |
| 4,431,248 | 2/1984 | Huntley et al. | 339/99 R |
| 4,579,414 | 4/1986 | Caveney et al. | 339/99 R |
| 4,619,493 | 10/1986 | Kikuta | 339/91 R |
| 4,668,039 | 5/1987 | Marzili | 339/99 R |
| 4,693,533 | 9/1987 | Szczesny et al. | 439/350 |
| 4,718,857 | 1/1988 | Noschese | 439/292 |

*Primary Examiner*—Gary F. Paumen

[57] ABSTRACT

A multiple conductor cable connector (1) is disclosed including a metallic clip (4) which latches a termination cover (5) and a housing (2). A projecting tab (18), a latch (20) and concave inner surfaces of the clip (4) grasp a handle (14) of the termination cover (5) to secure it to the clip (4). The termination cover (5) is recessed (15) to allow the clip tab (18) to fit flush with a rear surface (13) of the termination cover (5). Convex outer surfaces of sleeves (19) of the clip (4) cooperate with concave inner surfaces of channels (8) of opposed paired towers (7) on the housing (2) to guide the termination cover (5) towards the housing (2). Use of the clip (4) within the channels (8) provides a rigid structure for the connector (1), unaffected by normal handling. Inner surfaces of the channels (8) have protrusions (9) which cooperate with leading edges on the clip (4) to define a stop, and a cutout protrusion (24) on the clip (4) cooperates with a recess (10) and shoulder in the channel (8) inner surface; together these features define a pretermination position. A separate protrusion (11) on the housing (2) body cooperates with a separate recess (22) on the clip (4) to define a termination position and to latch the termination cover (5) to the housing (2).

16 Claims, 5 Drawing Sheets

18
4
20
19
23
22
21
24
18
4
20
17
19
22
23
21
15
5
14
16
13
1
12
14
15
3
16
7
8
7
6
8
2
7
10
11
7

18
4
20
19
19
17
23
23
22
21
24
25
18
15
19
19
4
5
24
14
4
20
12
19
16
17
19
22
23
21
6
8
7
7
10
11
2

25
24
19
21
9
2

25
7
24
2
19
9

25
24
7
8
2
19

25
23
24
7
8
10
2
21
9
19

MULTIPLE CONDUCTOR CABLE CONNECTOR WITH CLIP AND TOWERS

FIELD OF THE INVENTION

The invention relates to a connector and clip for insulation displacement termination of multiple conductor cable and, more particularly, to a metallic clip which stabilizes and secures the termination cover and connector housing using specially adapted channels on the housing and provides a rigid structure unaffected by normal handling.

BACKGROUND OF THE INVENTION

Electrical connectors for multiple conductor cables are well known in the art. However, as smaller connectors were demanded for a variety of applications, problems began to arise. Specifically, the connector had to be small enough to fit into the application. When two connectors are mated, their mating faces must fit exactly. Even though the size of a multiple conductor cable connector's mating face may be limited by the size of the mating face of a mating connector, for example, a connector attached to a printed circuit board, the cable receiving face of the connector must still be large enough to accommodate a cable, regardless of the dimensions of the connector's mating face. Not only might the surface area of the mating face be limited by the application, but a minimum height of the connector housing which must retain the limited cross sectional area may be required.

In addition, the reduced size connectors had difficulty with stability. The smaller parts were less able to maintain a termination cover and a housing in rigid position. Additionally, smaller connectors with small parts were more fragile. Plastic or other insulating material did not always have the strength to survive normal handling.

SUMMARY OF THE INVENTION

An object of the invention is to provide a multiple conductor cable connector with a reduced size mating face, but with a standard size cable receiving face. A feature of the invention which makes this possible is the use of towers integral to the housing projecting away from the mating face of the connector from a plane of the cable receiving face. It is the towers, rather than, for example, a housing shroud, which provide structure to secure the housing and a termination cover subassembly.

Another object of the invention is to provide a small multiple conductor cable connector which will provide stability. A feature utilized in carrying out this objective is a metallic clip which secures a termination cover to a housing. Use of metal rather than plastic, a typical insulator used in connectors, gives the connector greater strength. The clip is designed so that structures on one end of the clip cooperate to rigidly grasp a handle on the termination cover without extending beyond the termination cover.

Another feature of the invention is the use of paired opposed towers with inner channels. These towers project normal to the housing and the channels envelope the clip which conforms to the channels. An advantage of the invention is that the clip, and hence the termination cover, can move relative to the housing only along a line normal to their respective surfaces. The termination cover cable engaging face and the housing cable receiving face will remain aligned and parallel. Incorporation of the metallic clip and towers will serve to maintain rigid structure during normal handling of the connector.

DETAILED DESCRIPTION OF THE PREFERRED EMBODIMENT

Figure 1:
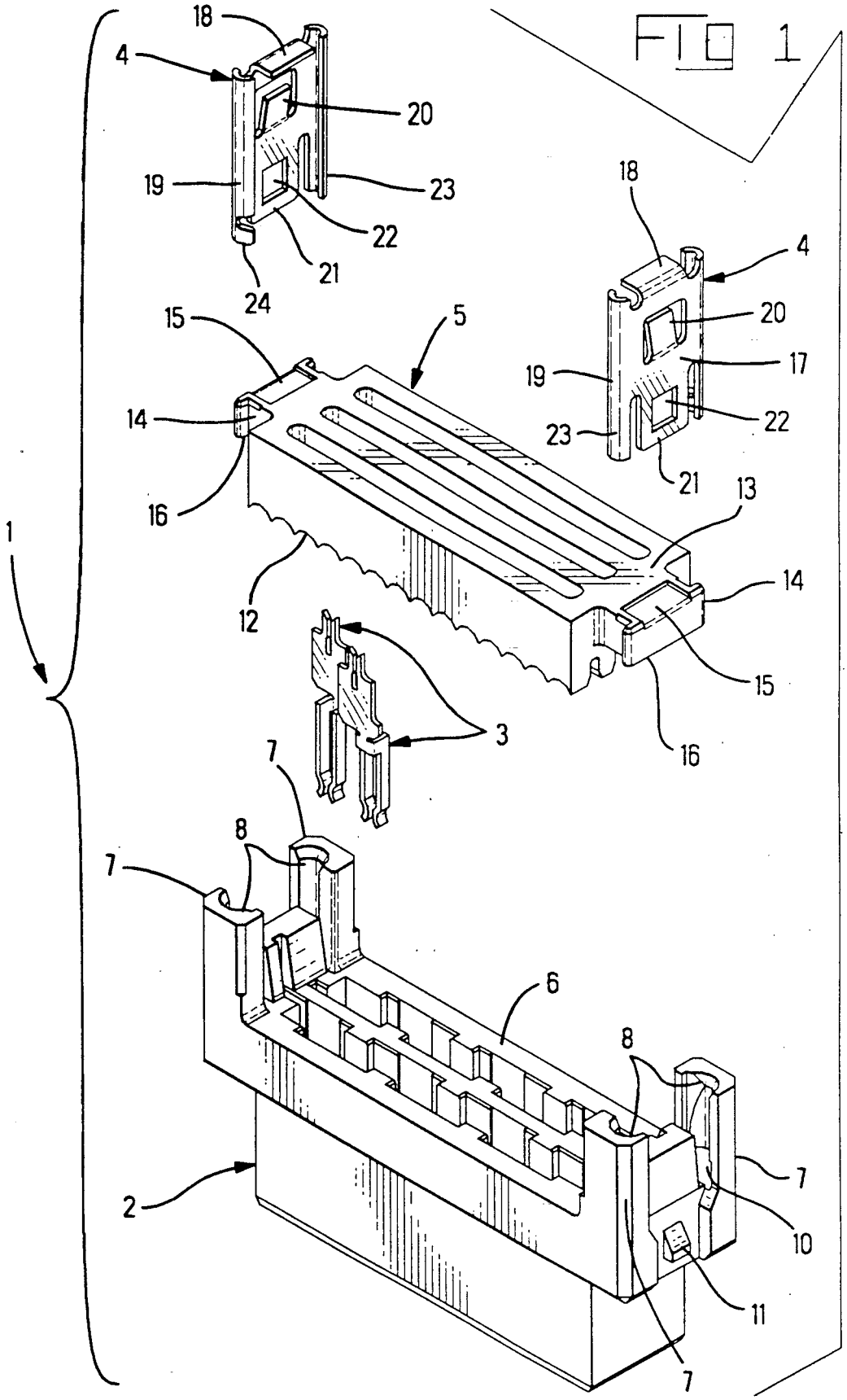
FIG. 1 is an exploded perspective view of a multiple conductor cable connector utilizing a clip in accordance with the present invention.

With more particular reference to the drawing, FIG. 1 shows a multiple conductor cable connector 1 exploded to reveal a housing 2, insulation displacement contacts 3, metallic clips 4, and a termination cover 5.

The housing 2 includes a cable receiving face 6, and two pairs of opposed towers 7. The towers 7 are perpendicular to cable receiving face 6, and have opposed concave channels 8. One of paired channels 8 has a pre-termination protrusion 9, as shown in FIG. 6. The other channel 8 has a pre-termination channel recess 10. Termination protrusions 11 are situated on the housing 2, below each pair of towers 7, recessed within the profile of housing 2.

Termination cover 5 has cable engaging face 12, rear surface 13, and handles 14. Cable engaging face 12 and rear surface 13 are on opposite sides of termination cover 5. Each handle 14 is convex and has recess 15 and bottom surface 16 on opposite sides of termination cover 5. Recess 15 is on the same side as rear surface 13; bottom surface 16 is on the same side as cable engaging face 12.

Figures 2, 3:
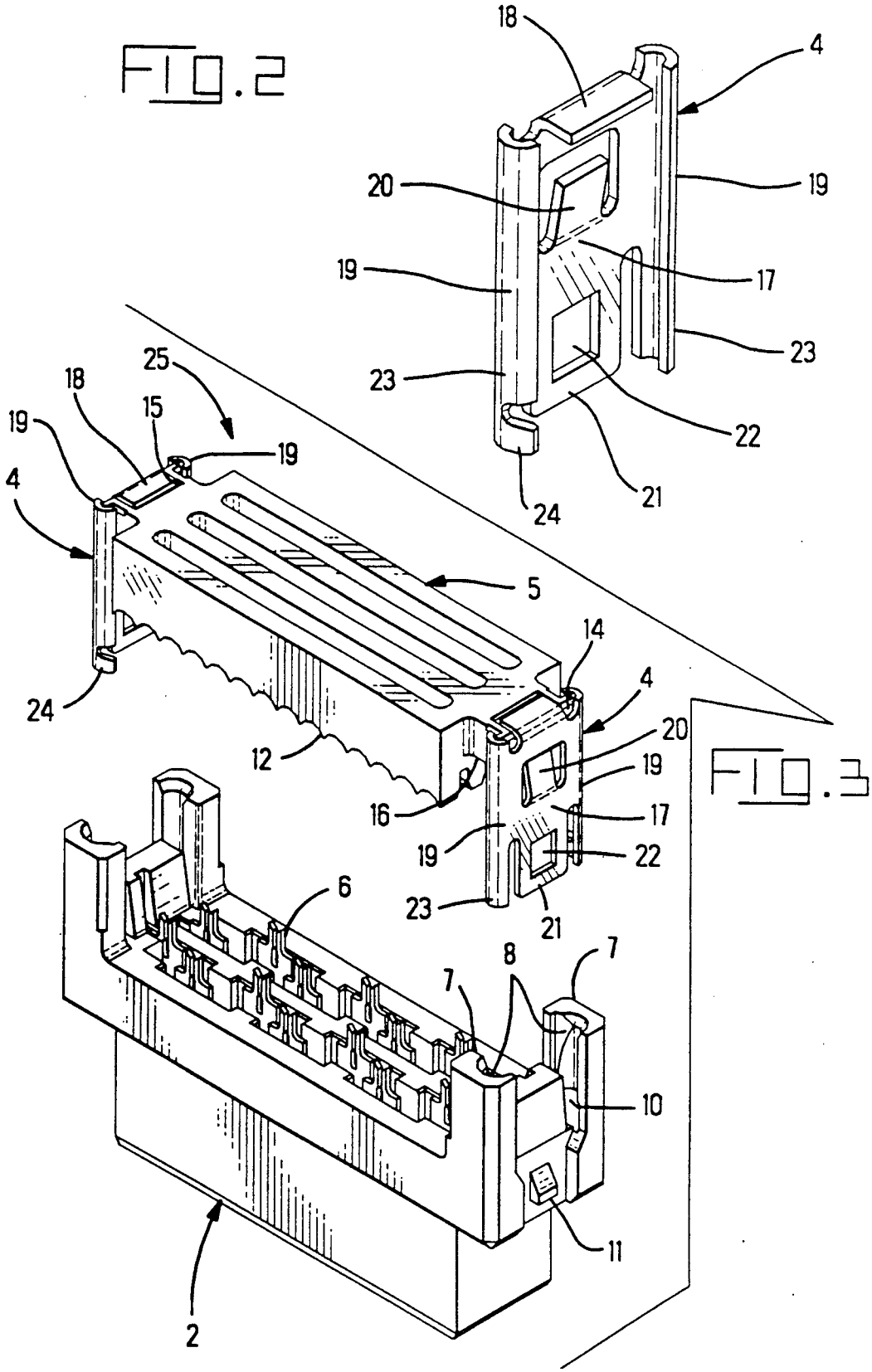
FIG. 2 is an enlarged perspective view of a clip of the connector shown in FIG. 1.
FIG. 3 is a perspective view of the connector shown in FIG. 1 with a termination cover subassembly and a housing.

With reference to FIG. 2, each clip 4 includes back 17, upper tab 18, a pair of sleeves 19, and lower tab 21. Set within back 17 is latch 20. Latch 20 is slightly deflected from the plane of back 17. Upper tab 18 projects from an edge of back 17 and is formed at a right angle to back 17, projecting in the same direction as latch 20. Lower tab 21 is in the plane of back 17 and extends from an edge of back 17 opposite upper tab 18. Lower tab 21 contains termination aperture 22, which could alternatively be a recess, to mate with housing termination protrusion 11. Sleeves 19 extend from side edges of clip back 17, curling in the same direction as upper tab 18 to form convex outer surfaces and concave inner surfaces. Lower portions 23 of sleeves 19 are separated from lower tab 21 by slots. On one of the two sleeve lower portions 23 is cutout 24. Cutout 24 is at the lowest end of one sleeve 19 and, rather than curling as sleeves 19 do, is partially curled so as to extend beyond the profile of sleeve 19.

The clip 4 is secured to the termination cover 5 by sliding handle 14, recess 15 first, through lower portions 23 of sleeves 19. After handle 14 passes lower tab 21, it reaches clip back 17. The handle 14 deflects latch 20 back into the plane of clip back 17. Once bottom surface 16 of handle 14 reaches the tip of latch 20 and recess 15 of handle 14 reach the upper tab 18, latch 20 resiles back to its normally deflected position. Handle 14 sits above latch 20 with bottom surface 16 of handle 14 engaged by latch 20. Recess 15 engages upper tab 18. Convex ends of handle 14 engage concave inner surfaces of sleeves 19. Handle 14 is now grasped by clip 4 to form cover subassembly 25. While sleeves 19 may extend beyond termination cover rear surface 13, upper tab 18 does not. FIG. 3 shows termination cover subassembly 25 and housing 2.

Figure 4:
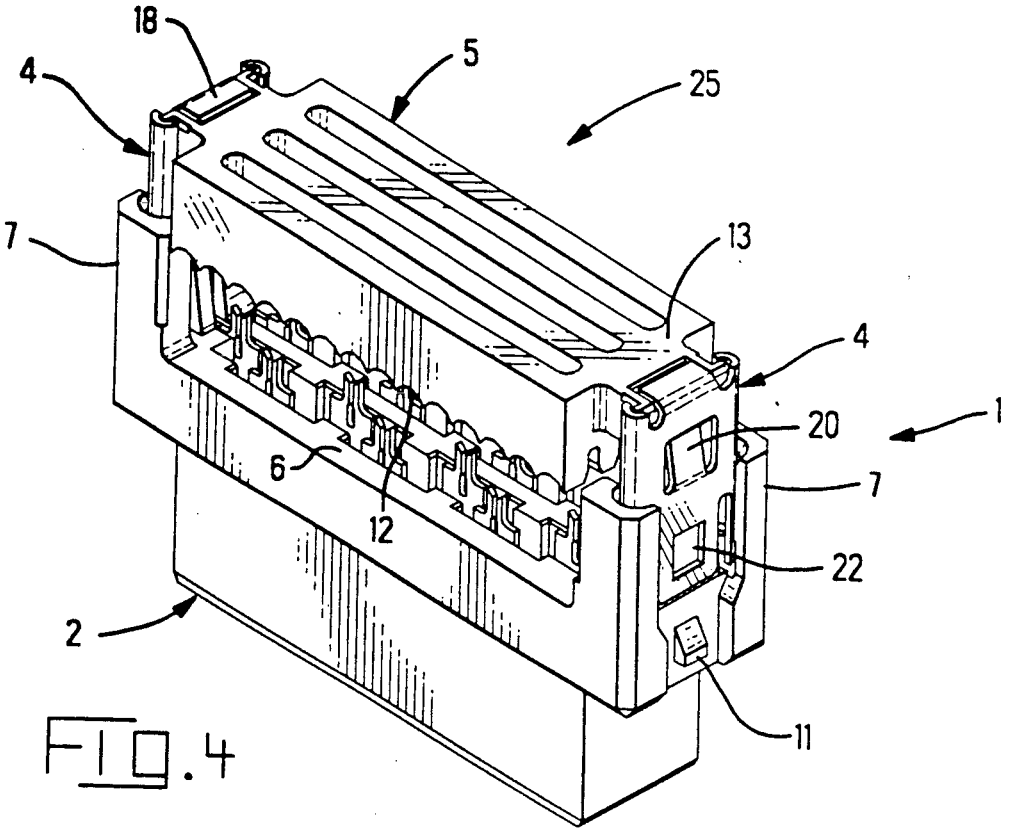
FIG. 4 is a perspective view of the connector shown in FIG. 1 with a termination cover subassembly and housing in a pre-termination position.
Figures 6A, 6B, 6C, 6D:
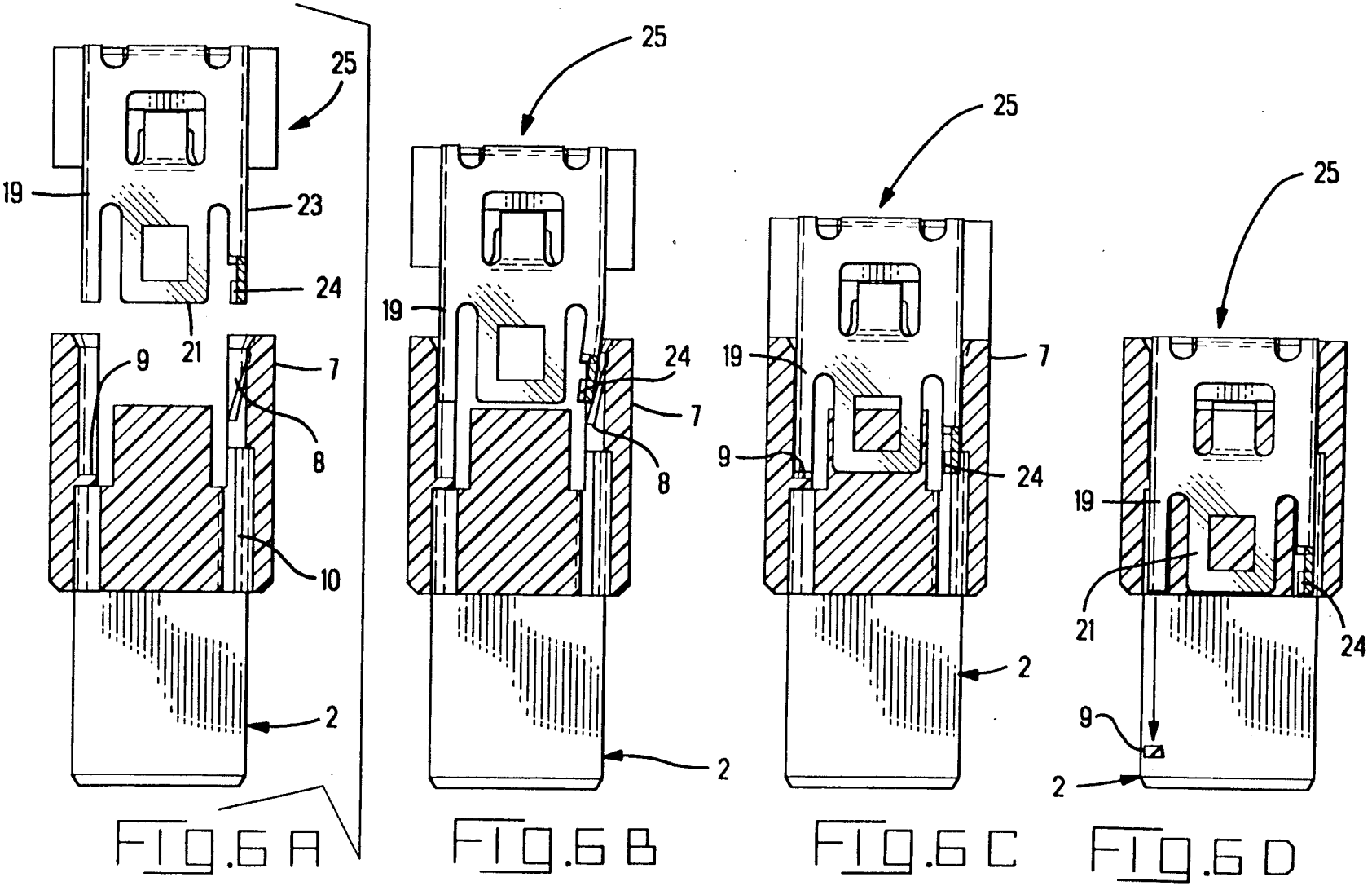
FIGS. 6(A–D) is a series of end elevation views partly in section of the connector shown in FIG. 1, in action sequence of (a) separate, (b) flexing prior to pre-termination position, (c) pre-termination position, and (d) termination position.
Figures 7A, 7B, 7C, 7D:
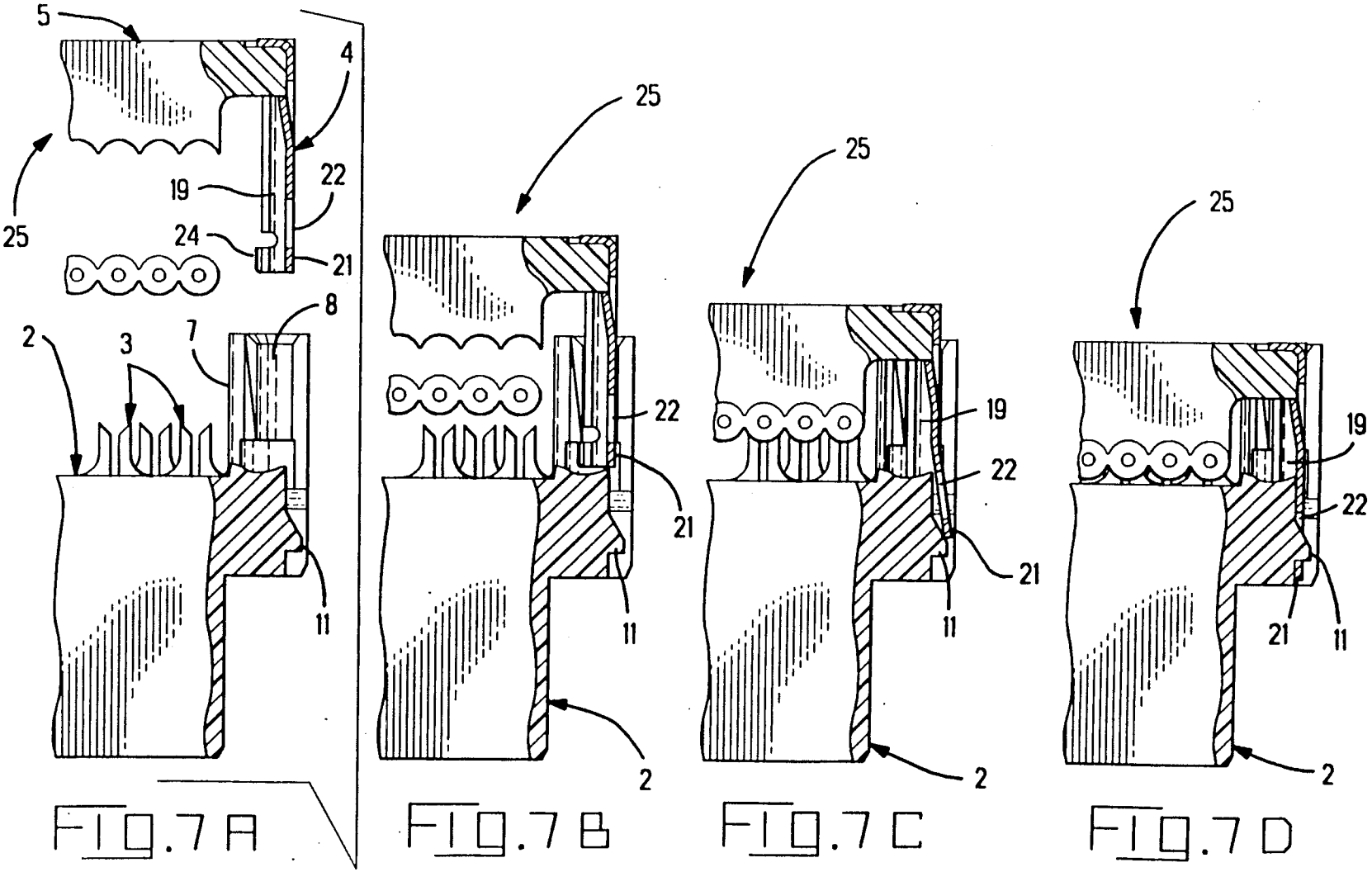
FIGS. 7(A–D) is a series of side elevation views partly in section of the connector shown in FIG. 1, with a ribbon cable, in action sequence of (a) separate, (b) pre-termination position, (c) flexing prior to termination position, and (d) termination position.

With reference to FIGS. 6 and 7, cover subassembly 25 is attached to housing 2 by first inserting clip 4 between towers 7. Convex outer surfaces of clip sleeves 19 conform to concave inner surfaces of channels 8 of the towers 7. This serves to align the cable engaging face 12 with cable receiving face 6, and also to keep them parallel. As shown in FIG. 6*b*, a sloped inner surface of channel 8 causes that sleeve 19 to flex towards the opposite sleeve 19 of that pair. In addition, the sloped channel surface deflects cutout 24, curling it towards alignment with sleeve 19. As shown in FIG. 6*c*, as cutout 24 reaches channel recess 10, it and sleeve 19 resile to their original positions. Cutout 24 engages a shoulder of channel recess 10, thereby preventing the cover subassembly 25 from being withdrawn from housing 2. At this point, lower portion 23 of opposite sleeve 19 engages pre-termination protrusion 9. This stop, in conjunction with cutout 24 in channel recess 10, defines a pre-termination position, as shown in FIGS. 4, 6*c* and 7*b*. In this position, there is sufficient space to insert a multiple conductor cable between termination cover cable engaging face 12 and housing cable receiving face 6. Inner corners of towers 7 are chamfered to more readily receive insertion of the cable.

Figure 5:
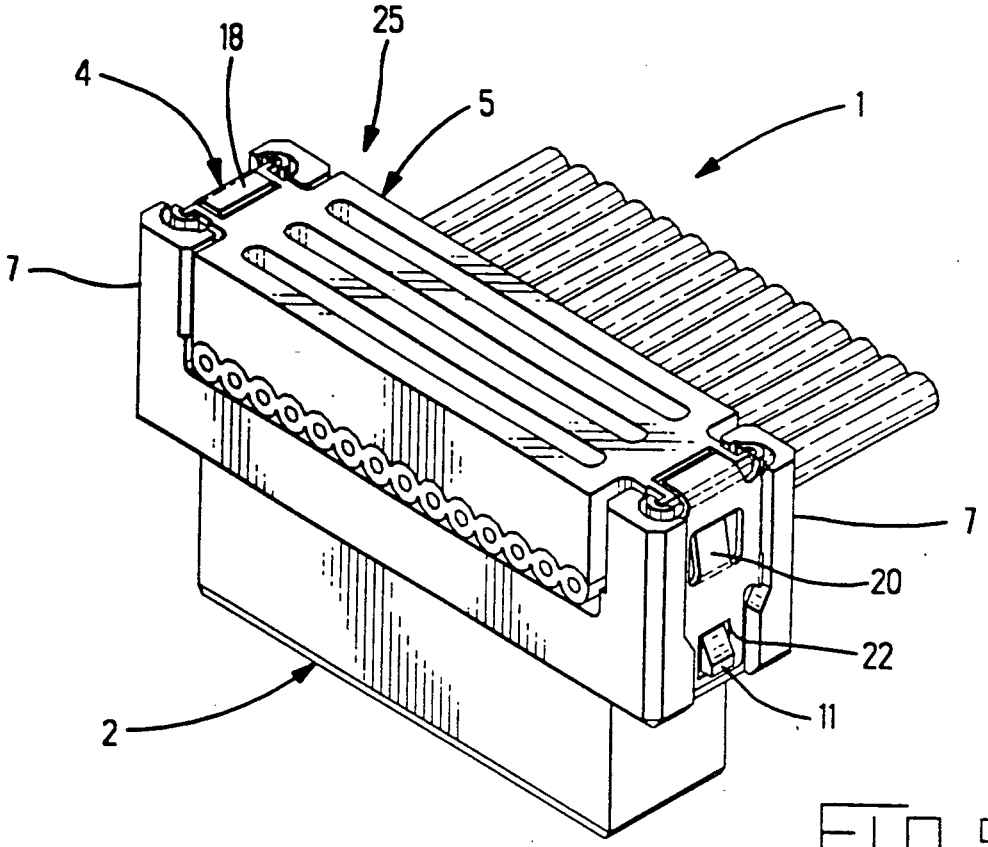
FIG. 5 is a perspective view of the connector shown in FIG. 1 with a termination cover subassembly and housing in a termination position, shown with a ribbon cable.

As clip 4 is forced farther through channels 8, bringing termination cover cable engaging face 12 and housing cable receiving face 6 closer together, a leading edge of lower portion 23 of sleeve 19 shears off or deforms pre-termination protrusion 9, as shown in FIG. 6*d*. Subsequently, lower tab 21 reaches termination protrusion 11. A leading edge of lower tab 21 rides up the ramp of termination protrusion 11, causing lower tab 21 to flex out of the plane of clip back 17, as shown in FIG. 7*c*. Termination aperture 22 then fits over termination protrusion 11, and lower tab 21 resiles back into the plane of clip back 17, to define a termination position in which cover subassembly 25 is secured to housing 2, as shown in FIGS. 5, 6*d* and 7*d*. The clip 4 is recessed within or flush with housing 2. In this termination position, a multiple conductor cable is held between termination cover cable engaging face 12 and housing cable receiving face 6, with individual conductors of the cable terminated to respective insulation displacement contacts 3.

Use of towers 7 in cooperation with clip 4 provides increased stability to connector 1 while in both the pre-termination position and the termination position. Use of metallic clip 4 gives the connector 1 more strength.

I claim:

1. A multiple conductor cable connector, comprising:

a termination cover having a handle;

a housing having a plurality of insulation displacement contacts; and a metallic clip, said clip cooperating with the handle of the termination cover, said clip having an upper tab, a back, and two sleeves, the upper tab being deformed from an edge of the clip back at substantially a right angle to the clip back, the sleeves being opposite each other and extending from side edges of the clip back substantially in the same direction as the upper tab;

whereby the handle cooperates with and is grasped by the combination of the upper tab, and along the height of the termination cover handle, the clip back and sleeves, said clip further having latch means for latching the termination cover to the clip, said clip and termination cover together defining a termination cover subassembly.

2. A multiple conductor cable connector as recited in claim 1, wherein:

the housing further has a cable receiving face and a pair of opposed towers, said pair of towers cooperating with the clip, and the termination cover has a cable engaging face;

whereby, as the sleeves pass through channels of the towers, the termination cover subassembly is guided cable engaging face first towards the cable receiving face of the housing.

3. A multiple conductor cable connector as recited in claim 2, wherein the clip and the pair of opposed towers are placed at one end of the housing, the connector further comprising a second like clip and a second like pair of opposed towers placed at an opposite end of the housing.

4. A multiple conductor cable connector comprising:

a termination cover subassembly having a termination cover and a metallic clip, said termination cover having a cable engaging face, said clip having a back, two opposed sleeves extending from side edges of the clip back, a lower tab extending from the clip back in the same plane as the clip back, and slots between the lower tab and lower portions of each sleeve; and a housing having a cable receiving face and a pair of opposed towers cooperable with the clip;

whereby as the clip passes through channels of the towers, guiding the termination cover subassembly cable engaging face first towards the cable receiving face of the housing, the lower portions of the sleeves are free to flex towards each other, and the lower tab is permitted to flex out of the plane of the clip back.

5. A multiple conductor cable connector as recited in claim 4, further comprising first securing means for securing the termination cover subassembly to the housing in a pre-termination position and second securing means for securing the termination cover subassembly to the housing in a termination position.

6. A multiple conductor cable connector as recited in claim 5, wherein:

the first securing means comprises protrusion means on the lower portion of a first sleeve cooperable with recess means in the corresponding channel, and protrusion means on the opposing channel cooperable with a leading edge of the lower portion of a second sleeve.

7. A multiple conductor cable connector as recited in claim 5, wherein the second securing means comprises recess means on the lower tab cooperable with protrusion means on the housing.

8. A multiple conductor cable connector as recited in claim 7, wherein the recess means comprises an aperture.

9. A multiple conductor cable connector as recited in claim 7, wherein the housing protrusion means and the lower tab are within the profile of the housing.

10. A multiple conductor cable connector as recited in claim 5, wherein the first securing means and the second securing means are mutually exclusive.

11. A metallic clip securable to a termination cover and adapted to latch the termination cover and a housing, said clip comprising:

a back;

latch means for latching the clip to the termination cover;

an upper tab integral with and extending from an edge of the back at substantially a right angle thereto; and two sleeves extending from opposite side edges of the clip back in substantially the same direction as the upper tab;

whereby the upper tab, sleeves, clip back and latch means cooperate to secure the clip to the termination cover.

12. A clip as recited in claim 11, wherein the latch means comprises a latch deformed from the plane of the clip back in the same direction as the upper tab and engaging a bottom surface of the termination cover.

13. A clip as recited in claim 11, wherein:

the termination cover has a rear surface and a recess which allows the upper tab to fit flush with the rear surface of the termination cover.

14. A clip as recited in claim 11, wherein:

the housing has a cable receiving face and at least one pair of opposed towers and the termination cover has a cable engaging face;

whereby, as the sleeves and clip pass through channels of the towers, the termination cover, secured to the clip, together defining a termination cover subassembly, is guided cable engaging face first towards the cable receiving face of the housing.

15. A metallic clip for securing a termination cover to a housing, said clip comprising:

a back;

securing means for securing the clip to the termination cover, the clip and termination cover together defining a termination cover subassembly;

first and second sleeves extending from opposite side edges of the clip back, each said sleeve having a lower portion;

a lower tab extending from an edge of the clip back in the same plane as the clip back in a direction away from the securing means; and slots between the lower tab and the lower portions of the sleeves;

thereby permitting flexure of the lower portions of the sleeves towards each other and of the lower tab out of the plane of the clip back.

16. A clip as recited in claim 15, wherein the housing has first and second opposed towers adapted to receive the clip, and the clip further comprises means for defining a pre-termination position and securing the termination cover subassembly to the housing in the pre-termination position, said defining and securing means comprising protrusion means on the lower portion of the first sleeve cooperable with recess means on an inner channel of the first tower and a leading edge of the second sleeve cooperable with protrusion means on an inner channel of the second tower.

* * * * *